United States Patent [19]

Lux

[11] 4,234,211

[45] Nov. 18, 1980

[54] SKI SAIL APPARATUS

[76] Inventor: Gregory Lux, 218 School St., Woburn, Mass. 01801

[21] Appl. No.: 33,553

[22] Filed: Apr. 27, 1979

[51] Int. Cl.[3] ..... A63C 11/00

[52] U.S. Cl. ..... 280/810

[58] Field of Search ..... 280/11.37 S, 16, 12 H, 280/810; 180/2 A, 180, 181; 9/310 R, 310 A, 310 E, 310 C, 310 D, 310 B; 114/39, 43

[56] References Cited

U.S. PATENT DOCUMENTS

| | | | |
|---|---|---|---|
| 3,707,935 | 1/1973 | Rachle | 114/39 |
| 3,742,886 | 7/1973 | Dillon | 280/11.37 S |
| 3,839,979 | 10/1974 | Wassell | 114/39 |
| 3,877,406 | 4/1975 | Davis | 114/39 |
| 3,981,258 | 9/1976 | Smith | 114/39 |
| 3,982,766 | 9/1976 | Budge | 280/11.37 S |
| 4,100,870 | 7/1978 | Prade | 114/39 |
| 4,130,292 | 12/1978 | Lorenz | 280/11.37 S |

FOREIGN PATENT DOCUMENTS

| | | | |
|---|---|---|---|
| 13780 | 6/1903 | Austria | 280/11.37 S |

*Primary Examiner*—David M. Mitchell
*Attorney, Agent, or Firm*—William Nitkin

[57] ABSTRACT

A sail apparatus to be utilized by an individual wearing skis comprising sail means with means for affixing said sail means to said skis and control means for the control of said sail means.

2 Claims, 2 Drawing Figures

SKI SAIL APPARATUS

BACKGROUND OF THE INVENTION

FIELD OF THE INVENTION

The apparatus of this invention resides in the area of recreational equipment and more particularly relates to a ski sail apparatus.

Sail means have been incorporated in a wide range of recreational equipment. Besides the familiar sail means on recreational boats and canoes, sail means have been adapted for placement on iceboats which sail at high speeds upon frozen lakes. Ice skaters have also used handheld sails for propulsion. In water skiing one may fly a large kite-like structure behind him as he is towed by a boat. When the boat reaches a particular speed, the water skier sill be lifted off the water and be held aloft in the air by the action of the kite in the wind.

SUMMARY OF THE INVENTION

It is an object of this invention to combine wind-powered movement with both regular and cross-country skiing.

It is a further object of this invention to provide a device which is lightweight and maneuverable by the individual user.

It is yet an additional object of this invention to provide an apparatus which can be installed on an individual's skis to accomplish ski-sailing.

DESCRIPTION OF THE PREFERRED EMBODIMENT(S)

Figure 1:
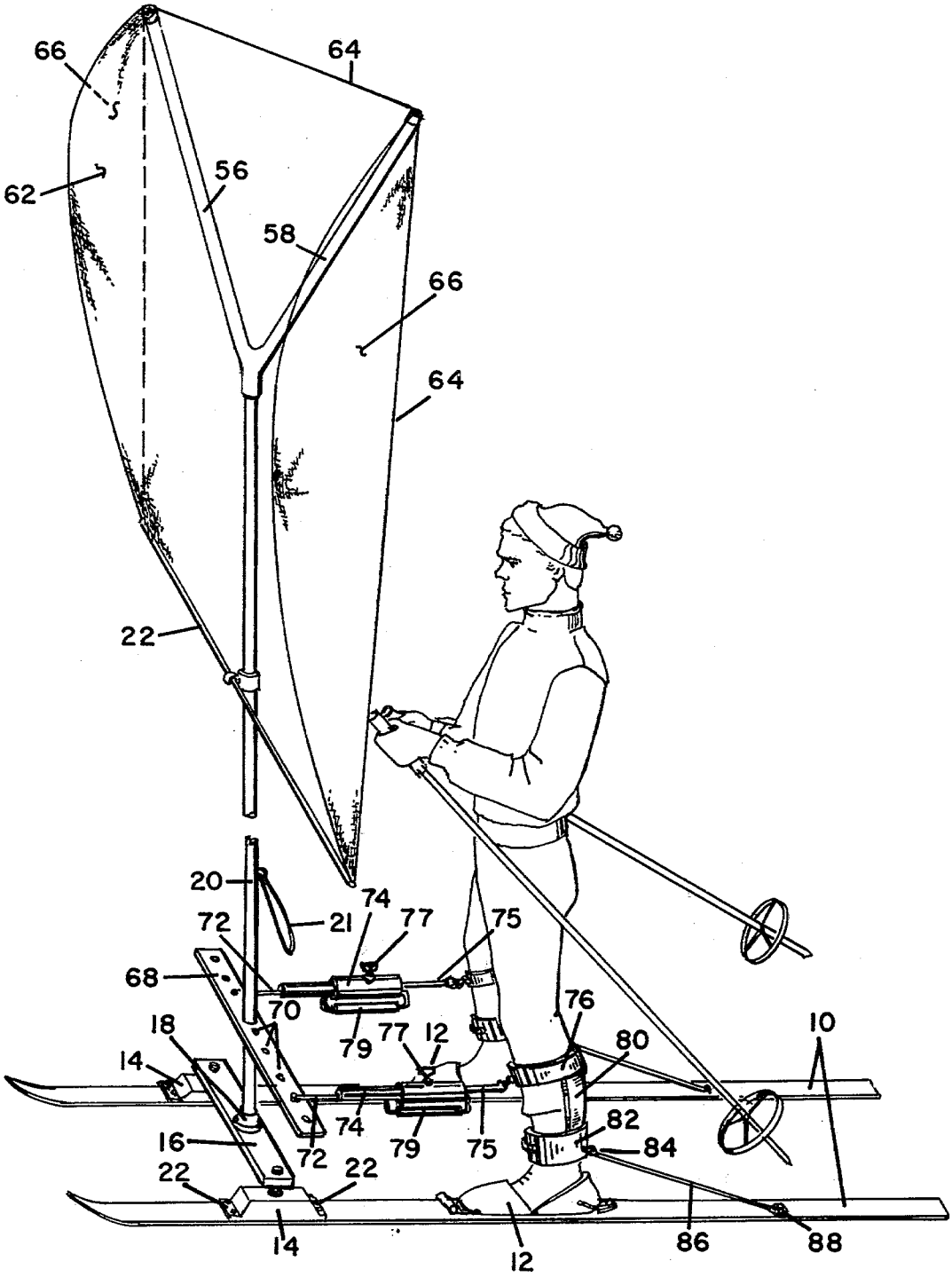
FIG. 1 illustrates a perspective view of the apparatus of this invention installed on a pair of skis.

FIG. 1 illustrates a perspective view of a skier utilizing the device of this invention installed on a pair of skis 10 having a standard ski shoe binding 12 thereon. Positioned on the front quarter of the skis are the members of the apparatus of this invention described below. The exact positioning of these members can be performed after the skis are purchased as the positioning can best be determined in conjunction with the weight and height of the individual who will be using the ski sail apparatus. Affixed to each ski is ball joint member 14. These ball joint members 14, described in further detail below, allow for a cross plate 16 to be affixed operatively thereto upon which the sail apparatus rests, which structure will be described in additional detail below. The width of cross plate 16 can be in the vicinity of 17 inches and also can be adjustable by utilizing sliding members. The exact width can best be determined by the skier utilizing the ski sail apparatus. Centrally positioned in the top portion of cross plate 16 is socket member 18 which is adapted for receipt of sail mast 20. The outer structure of each ball joint member 14 can be cast of aluminum or equivalent light-weight metal or strong plastic adapted to be affixed to the ski. Such affixation can be by means of retainer flanges 22 on either end thereof and the flanges will hold ball joint member 14 to the top surface of the skis by screw members affixing each flange to a ski or by equivalent means of attachment. It should be noted that cross-country skis can be as narrow as 2 inches so that it is envisioned that the approximate width of the ball joint members will be 2 inches.

Figure 2:
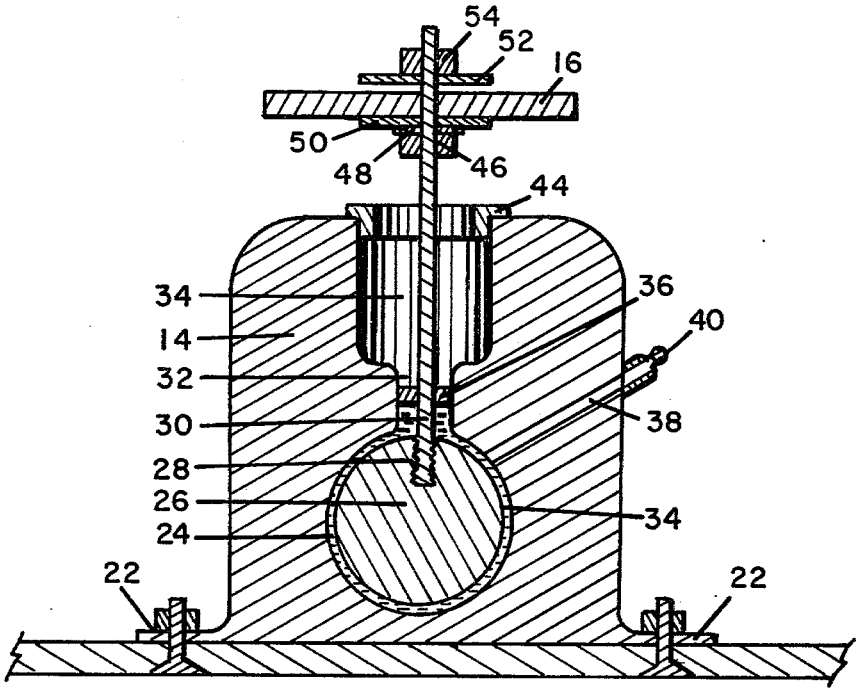
FIG. 2 illustrates a cross-sectional view through a ball-joint affixed to the top of a ski.

Seen in further detail in FIG. 2, which is a cross section through one of ball joint members 14, is ball socket 24 which is round and adapted to enclose snugly ball member 26 which is adapted to rotate freely therein. Ball member 26 has an aperture 28 defined therein adapted to receive threaded rod 30. This rod protrudes out of the top of the ball socket 24 through narrow opening 32 which opens into joint well 34. It has been found advantageous to have a grease-type lubricant 35 or equivalent around ball member 26 within ball socket 24 to assist in easy movement thereof. Rubber boot 36 acts as a grease seal for retaining the lubricant 36 within the ball socket. In addition, one can have means for adding additional grease. If desired additional grease can be entered through grease line 38 which terminates in grease fitting 40. It should be noted that the threaded rod can be rotated within the perimeter of the top of the joint well 34 easily in the structure described. It has been found advantageous in relieving pressure placed by the threaded rod against the upper edges of the joint well to insert a ring 44 therein made of steel or equivalent hard material to prevent wear on the casting and to maintain close tolerances in the movement to and fro of threaded rod 30. Threaded rod 30 extends upwards to a threaded portion having a nut 46 thereon and a first smaller washer 48 and a larger washer 50. Rod 30 is then passed through an aperture defined in cross plate 16 and a second larger washer 52 is affixed over the top of the threaded rod and a second nut 54 is tightened over that larger washer so that the cross plate member is securely affixed to the threaded rod and can move within the range of movement allowed threaded rod 30. Nut 52 and 46 can be adapted so as not to hold cross plate 16 too snugly so as not to hinder play thereof. In a similar fashion the other ball joint member is affixed onto the other ski and to cross plate 16. At a central point on cross plate 16 is socket member 18 which is affixed thereto and can extend in a collar fashion approximately 4 inches thereabove. Into socket member 18 is rotatably affixed mast 20 of the sail element described below. The sail element consists of a mast 20 which mast can be constructed of aluminum, magnesium, a combination thereof, or any equivalent lightweight strong material which can withstand the pressures to be normally place thereon. Mast 20 is adapted to first extend approximately 6 feet to a cross mast 22 which is affixed thereto by U-brackets or equivalent means of affixation. These mast structures can be constructed in tubular form having a bored core to make them lighter but yet still retain proper strength. For example, if mast 20 is 1 inch in diameter, then a $\frac{1}{4}$ inch diameter core can be utilized. Cross mast 22 extends approximately 5 feet on both sides of mast 20. Mast 20 extends further upwards approximately 6 feet where it bifurcates into two corner support masts 56 and 60. These corner support masts extend from angles from mast 20 to the upper corners of sail member 62 and are affixed thereto by standard means of affixation such as bolts or other means. Cable member 64 extends between the ends of the corner support masts 56 and 58 and further down on either side of the sail member to the ends of cross mast 22. Sail 62 can be in one piece or can be composed of Dacron, a trademark, or equivalent lightweight material, and have side portions 66 along each side thereof, when the sail is bowed outward by wind, whose ends conform to the bowed out element of said 62 when wind blows therein, and the other end of side portions 66 being affixed to the cable member 64 on either side of sail 62. Affixed at a portion of mast 20 above its affixation to the socket 18 and below cross mast 56 at a point best determined in reference to the height of the individual utilizing the ski sail is a torsion bar 68 which can be composed of a strong metal or equivalent material and affixed to mast 20 by welding, U-bolts or equivalent means of affixation, having a plurality of apertures 70 defined on either side thereof into which are affixed control rods 72. Each rod 72 extends to a hydraulic shock absorber 74 or equivalent to assist in cushioning and dampening the forward movement of control rods 72. Torsion rod 68 is adapted to reduce instantaneous forward movements of the mast caused by wind by causing that movement to be absorbed within shock absorbers 74. Shock absorbers 74 include means of interconnection by rods 75 extending to leg band member 76 constructed of fiberglass or equivalent adapted in size to fit around each calf of the individual utilizing the apparatus. Leg band 76 can have interconnected therewith a back portion 80 being constructed of fiberglass or equivalent with padding on the inside which extends down along on the outer side of the calf and terminates in strap member 82 of approximately 4 inches in width located at the base of the calf approximately 4 inches above the ankle. Strap member 82 along with the back portion 80 assists in absorbing the shock of movement forward of the torsion rods 68. For additional support one can have eye member 84 affixed at the base of the 4 inch strap member 82. Extending from eye member 84 is cable 86 which runs to second eye member 88 affixed to the upper surface of ski 10 behind ski boot brackets 12 to help provide additional stability. In use one would first slide band 76 and its associated padding and straps 80 and 82 onto one's legs and then step into the ski boot bracket 12. Lift strap 21 can be affixed to mast 20 to assist in raising the mast from a forwardly inclined position where it would be at rest to an operative position. Torsion bar 68 is adjustable for control rods 72 to be inserted into preselected apertures 76 depending upon the amount of pressure and strength of the wind that one feels he will encounter in using the device which determines into which of apertures 70 one will insert the hooks of control rods 72.

The piston within the cylinder of hydraulic shock absorber 74 can be released by the user opening valve 79 or equivalent which releases fluid therefrom into a reservoir tank 79 allowing sail mast 20 to move forward to reduce the apparatus' effective speed. The fluid can be returned to the shock absorber 74 when desired by the user raising sail mast 20 by pulling back on mast loop 21 thereby forcing fluid from the reserve tank back into the cylinder of shock absorber 74.

Although the present invention has been described with reference to particular embodiments, it will be apparent to those skilled in the art that variations and modifications can be substituted therefor without departing from the principles and spirit of the invention.

I claim:

1. A sail apparatus to be utilized with snow skis comprising:

sail means;

means for affixing said sail means to said skis;

control means for the control of said sail means;

wherein said sail means include:

a sail member;

a mast member upon which said sail member is mounted;

pivot means for affixing said sail means to said skis, said pivot means affixed to each of said skis;

a cross member attached to said pivot means;

a mast receipt member affixed to said cross member;

wherein said control means include:

a torsion bar affixed to said mast;

attachment means to interconnect the skier to said torsion bar; and wherein said attachment means include a rod member adapted to be interconnected to said torsion bar;

leg members adapted to be affixed to the skier's calves; and shock absorbing means interposed between and interconnected with said rod member and said leg members.

2. A sail apparatus to be utilized with a pair of snow skis comprising:

a pair of ball joint members each affixed to one of said skis, each of said ball joint members having defined therein a ball socket aperture;

a pair of ball members, each positioned within the ball socket aperture of a ball joint member, each of said ball members having a threaded aperture defined therein;

a joint well defined within the top of each of said ball joint members and having an aperture opening into the top of said ball socket aperture;

a pair of threaded rods, each adapted to be inserted into a said joint well and through said aperture at the top of said ball socket aperture and screwed into the threaded aperture defined in said ball member;

a hard ring member positioned around the top of said joint well adapted to limit the movement of said threaded rod and prevent wear of said joint well;

a cross plate member having apertures defined at each end thereof, each adapted to receive a threaded rod extending from each of said ball joint members;

a first nut member positioned upon each of said threaded rods below said cross plate member;

a first washer positioned upon each of said threaded rods below said cross plate member;

a second washer positioned upon each of said threaded rods above said cross plate member;

a second nut member affixed to each of said threaded rods above said cross plate member;

a mast socket member centrally affixed to said cross plate member;

a sail mast adapted to be inserted into said socket member;

a sail member;

a cross mast affixed to said sail mast;

a corner support mast comprised of two members bifurcating from a point of interconnection with said sail mast adapted to support said sail member;

a cable member extending from said cross mast to the corners of said bifurcated corner support masts and to the opposite end of said cross mast;

a torsion control bar having a plurality of apertures defined therein, said bar being affixed to said sail mast;

a pair of rod members adapted to be interconnected into a selected of said apertures in said torsion control bar;

an hydraulic cylinder cushioning means affixed to each of said rod members; and band means adapted to affix around the calves of the individual using the apparatus of this invention including means for affixation of said hydraulic cylinder cushioning means to said band means, said band means including a downwardly extending portion and a lower strap member adapted to be affixed around the lower portion of the leg of said user, a first eye member positioned upon said lower strap member, a second eye member affixed to said ski member at a position behind the user; and a cable member affixing said first eye member to said second eye member.

* * * * *